United States Patent [19]

Peterson

[11] 4,347,490

[45] Aug. 31, 1982

[54] LOW PROFILE TRANSFORMER

[75] Inventor: David A. Peterson, McHenry, Ill.

[73] Assignee: Prem Magnetics, Inc., McHenry, Ill.

[21] Appl. No.: 241,447

[22] Filed: Mar. 6, 1981

[51] Int. Cl.[3] ..... H01F 15/10; H01F 27/30

[52] U.S. Cl. ..... 336/60; 336/65; 336/192; 336/198

[58] Field of Search ..... 336/65, 192, 105, 107, 336/92, 198, 208, 60

[56] References Cited

U.S. PATENT DOCUMENTS

| | | | |
|---|---|---|---|
| 3,516,040 | 6/1970 | Ripley et al. | 336/192 X |
| 3,665,358 | 5/1972 | Leuck et al. | 336/192 X |
| 3,760,339 | 9/1973 | Marshall | 336/192 X |

*Primary Examiner*—Thomas J. Kozma
*Attorney, Agent, or Firm*—Leo J. Aubel; Robert E. Browne

[57] ABSTRACT

A low profile transformer includes an E - I core having two outer legs and center leg. A pair of connecting pin headers have recesses in friction-fit contact with the inner portions of the outer legs; each header is also recessed, at each end, and is in friction-fit contact with the inner portion of the E-core which joins the legs and the I-bar. A coil wound bobbin on the center core leg has flanges which abut and brace against the pin headers to secure said headers in position. Pins on the headers enable mounting on a printed circuit board.

10 Claims, 6 Drawing Figures

LOW PROFILE TRANSFORMER

TECHNICAL FIELD

A transformer for use in conjunction with printed circuit board applications, which transformer has a small height dimension to be compatible with the other electronic components mounted on the P.C. board. The term transformer as used herein also refers to a single winding inductor.

BACKGROUND OF INVENTION

Printed circuit (P.C.) boards are extensively used in a variety of electronic applications. P.C. boards enjoy wide application, in the field of telecommunications, such as for example, in telephone switching centers where large numbers of P.C. boards are mounted in parallel relation on accommodating racks. It is desirable that the P.C. be mounted as closely adjacent to one another as possible in order to conserve floor and rack space. Close spacing also affords certain practical operating advantages. Further the electronic components generally used in, or in conjunction with, P.C. boards are of relatively small size both in the horizontal and vertical dimensions.

Transformers are frequently mounted on a P.C. board. Such transformers have generally been the components on a P.C. board having the largest vertical dimension; that is, the dimension perpendicular to the plane or surface of the P.C. board. Hence the transformer is the component that determines the minimum spacing between adjacent P.C. boards. Stated in other words, present transformers are of considerably higher dimensions than the integrated circuit chips (IC's), transistors, capacitors, and other components used with the P.C. boards, and accordingly the transformers have been the critical space factor in the mounting of P.C. boards.

SUMMARY OF THE INVENTION

The invention comprises a transformer of low profile, that is, a transformer of minimal height which transformer is compatible with the dimensions of existing electronic components used with P.C. boards and which transformer has the same or similar performance characteristics as prior art transformers.

The foregoing features and advantages of the present invention will be apparent from the following more particular description of the invention. The accompanying drawings listed hereinbelow are useful in explaining the invention wherein:

BRIEF DESCRIPTION OF SEVERAL VIEWS OF DRAWINGS

DETAILED DESCRIPTION

Figure 1:
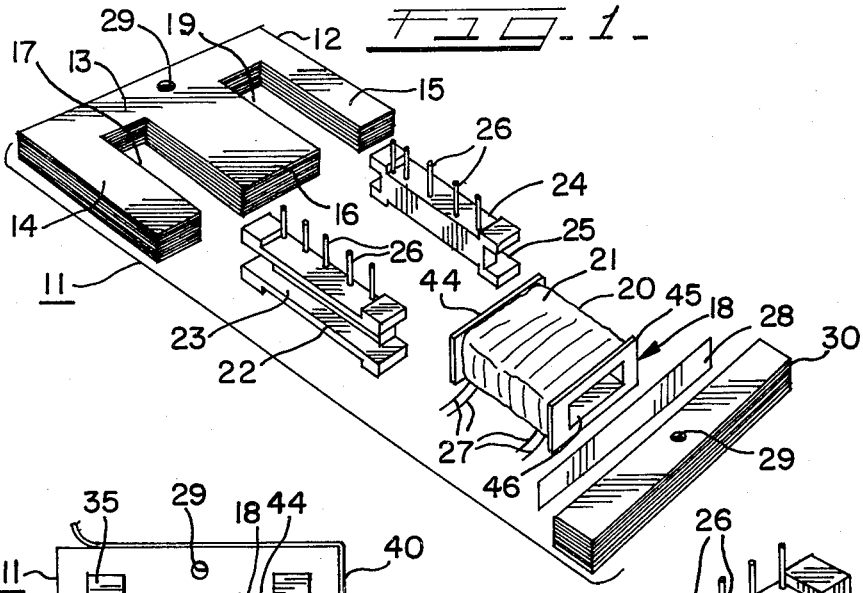
FIG. 1 is an exploded isometric view of one embodiment of the inventive transformer with an E-I core configuration showing the various components of the transformer.
Figure 2:
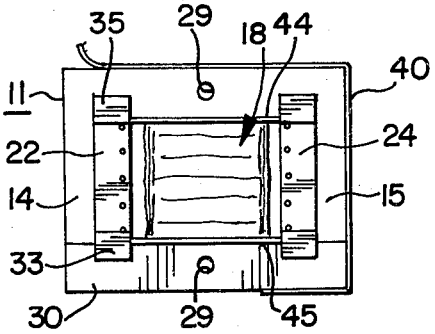
FIG. 2 is a plan view of the inventive transformer.
Figure 4:
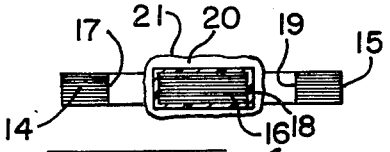
FIG. 4 is an end view of the coil winding mounted on the transformer core.

FIG. 1 shows an exploded view of the inventive transformer 11 and FIG. 2 is a plan view of the assembled unit. Transformer 11 comprises an E-shaped laminated core 12. Core 12 includes a stem portion 13, outer legs 14, 15, and a center leg 16. Windows in spaces 17 and 19 are formed between center leg 16 and outer legs 14 and 15, respectively. A bobbin 18 is inserted in position around leg 16, (See FIG. 4). A coil of wire (winding) 20 is wound around bobbin 18 and comprises the primary and secondary windings of a transformer with input and output leads, as needed, generally labeled 27, as is known in the art. The bobbin 18 itself may be formed of any suitable known relatively hard plastic, and the coil is covered by a thin insulating plastic sheet 21. Bobbin 18 includes end flanges 44 and 45 for purposes to be described.

Figure 3:
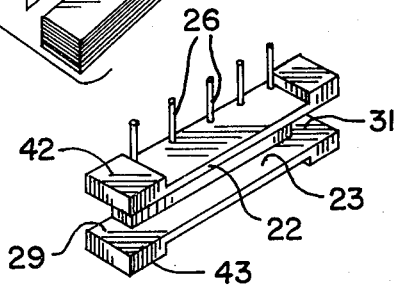
FIG. 3 is an enlarged isometric view of a connecting pin header of FIG. 1.
Figure 5:
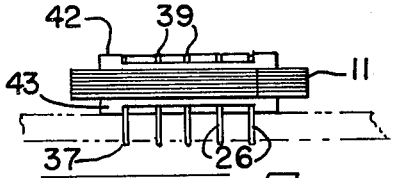
FIG. 5 is a side view of the transformer indicated as mounted on a P.C. board.

A pair of connecting pin headers 22 and 24 include a plurality of connecting pins 26 mounted therein. Pins 26 extend through the respective headers for insertion into the associated P.C. board, as indicated in FIG. 5, to provide electrical contact with the associated electronic circuitry, not shown. The pin headers 22 and 24 which are formed to each have a recess therein labeled 23 and 25, respectively slide onto and accommodate the inward portions of legs 14 and 15. The headers 22 and 24 are essentially in friction-fit contact with the respective legs. The headers 22 and 24 are also recessed at their ends as at 29 and 31 in FIG. 3 to receive, in friction-fit contact, the inward portion of the stem 13 and of the I-bar 30 as at 33 and 35 in FIG. 2. Likewise, the bobbin 18 includes a central hole 46 which fits closely around the leg 16 to be securely positioned thereby. Flanges 44 and 45 on bobbin 18 abut and brace against the pin headers 22 and 24 (see FIG. 2) to secure the headers in position.

A strip of magnetic gapping (insulating) material 28 may, for certain applications, be positioned between the end of the legs 12 and 14; and, an I-bar lamination 30 positioned across the open ends of the legs 14 and 15 to cap the assembly; that is, to complete the structure as shown in FIG. 2. An interleaved assembly of alternate E's and I bars may also be used in some applications. The I-bar 30 is secured to the core 12 by a tape 35, of width substantially equal to the height of the stacked core laminations, which tape is wrapped around the entire core 12 and the I-bar 30. A suitable adhesive could likewise be used to affix the I-bar to the core or, a conventional channel may be used.

Mounting holes generally labeled 29 are formed through core 12 and I-bar 30 to receive the screws or bolts for mounting the transformer 11 to the P.C. board, if desired.

FIG. 5 shows the completed assembly of FIG. 2 as mounted on an associated P.C. board shown in phantom. The lower end 37 of pins 26 extend through the P.C. board when the transformer 11 is mounted in position to provide the electrical connections to the associated electronic circuitry on the P.C. board. The upper ends 39 of pins 26 extend upwardly only to the maximum height of the headers, that is, the upper ends 39 of pins 26 are no higher than the rest of the assembly. At this junction, the coil lead ends are terminated.

Pin headers 22 and 24 each include two shoulders 42 or depending projections at the ends thereof. (See shoulders labeled 42 and 43, FIG. 3). As will be appreciated by reference to FIG. 5, the shoulders permit cleaning liquid to flow beneath the mounted transformer 11 and the associated P.C. board. This also, of course, provides a spacing between the P.C. board and the transformer 11 to provide air flow beneath the transformer.

The connecting pins 26 are mounted on headers 22 and 24 which are separate assemblies from the bobbin 18. The header pin assembly including the headers and pins 26 does not add any height to the overall transformer 11 structure, see FIG. 5.

It was found that a low or flat laminated core 12 structure provides substantially large windows or space 17 and 19. The present assembly utilizes these windows 17 and 19 to mount the connecting pin headers 22 and 24, pins 26, and the associated bobbin 18 and coil 20 to thereby keep the connecting pin assembly, and the coil and bobbin from adding any height to the transformer dimensions. Thus the inventive transformer utilizes the window space which is normally of little practical use, to minimize the profile or height of the transformer assembly.

Stated in another way, in order to maximize the output of the transformer either more copper or more core area is required. In the inventive transformer less copper area is used and thereby it is necessary to utilize greater cross sectional core area for a given power handling capability, note FIG. 4. A core structure permitting the utilization of more core area results in forming larger windows which space is normally wasted. The inventive transformer utilizes the window space to accommodate the coil and the connecting pin headers, and thus maintains the transformer profile height at a minimum.

Figure 6:
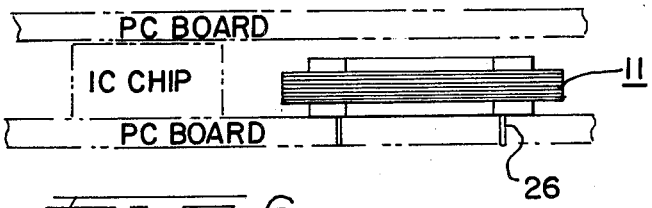
FIG. 6 is a side view of the inventive transformer as mounted between two P.C. boards.

FIG. 6 shows a basic advantage of the transformer of FIGS. 1 and 2. As indicated in FIG. 6, the P.C. boards (such as for telephone switching centers) are ideally mounted at a spacing of about $\frac{1}{2}''$ between the boards. Any IC chips or other electronic components are normally less than $\frac{1}{2}''$ in height and hence can be suitably mounted between the P.C. boards. One embodiment of the inventive transformer is approximately $\frac{3}{8}''$, thereby giving a suitable $\frac{1}{8}''$ clearance between the top of the transformer 11 and the adjacent surface of the P.C. board.

In said embodiment, the dimensions of the overall inventive transformer 11 are $1\frac{7}{8}''$ length$\times$1 9/16″ width$\times\frac{3}{8}''$ height. The laminations used in the embodiment shown are the standard laminations of 0.014″ thickness. However, the transformer dimensions may be scaled up or down as required. Further, while an E-shape laminated core is shown, F-shaped laminated cores or other configurations or materials could likewise be used.

The method of assembly of the components of the structure as shown in FIG. 1 to form the completed transformer 11 of FIG. 12 is as follows: The stacked E-core laminations form a core 12 of the desired thickness. The recesses 23 and 25 of headers 22 and 24 which carry the connecting pins 26 are slideably inserted onto the inner side of legs 14 and 15 respectively from the open end of the legs. The bobbin 18 carrying coil 20 is inserted onto the center leg 16 from the open end of the leg. The gapping material 28 is placed across the open ends of the legs 14, 15 and 16. Next, the I-bar 30 is placed against the material and the open ends of the legs 14, 15 and 16, and secured in position by a narrow strip of tape 30 which is wrapped several turns around the periphery of core 12 and I-bar 30. The coil leads 27 are then soldered to the connecting pins 26. The transformer 11 is then in condition for use.

While the invention has been particularly shown and described with reference to preferred embodiments thereof, it will be understood by those skilled in the art, that various changes in form and details may be made therein without departing from the spirit and scope of the invention.

I claim:

1. A low profile transformer comprising in combination, a magnetic core having a stem, two outer legs and a center leg, a window formed between the center leg and each of the outer legs, a bobbin assembly including coil windings thereon received by said center leg, connecting pin headers mounted onto said inner side of said outer legs in said windows, pins connecting to associated electronic circuitry mounted on said headers, and said pin headers, said coil windings and said core being of substantially the same height.

2. A transformer as in claim 1 wherein said pins extend through said headers, and said headers are slidably mounted on the inner side of said legs and positioned in the window, whereby said headers are essentially no higher than the height of said bobbin assembly.

3. A transformer as in claim 1 wherein the one end of pins mounted on said header terminate in a plane substantially parallel to the maximum height of said header, and the other end of the pins extend downwardly to be insertable into the associated P.C. board.

4. A transformer as in claim 1 wherein said core further includes an elongated member extending across the open end of said legs, said headers having a first recess accommodating a portion of said outer legs and a second recess accommodating an inner portion of said elongated member and a third recess accommodating an inner portion of said stem whereby the header is secured in position.

5. A transformer as in claim 4 wherein said recesses are contiguous in the same plane.

6. A transformer as in claim 1 wherein said headers and the connecting pins thereon are spaced from said bobbin assembly.

7. A transformer as in claim 1 wherein said headers have depending shoulders on the ends thereof and a reduced intermediate portion wherein said pins are mounted and whereby a passageway is formed by said reduced portion for such as for liquid cleaning solvents.

8. A transformer as in claim 1 wherein the bobbin includes outwardly extending flanges abutting against said headers and bracing said headers in position.

9. A transformer as in claim 1 further comprising F-shaped cores.

10. A transformer as in claim 1 wherein the height of said transformer is less than one-half inch.

* * * * *